US005232042A

United States Patent [19]

Giron et al.

[11] Patent Number: 5,232,042

[45] Date of Patent: Aug. 3, 1993

[54] MOLD FOR CASTING METAL INGOT SOWS AND METHOD

[75] Inventors: Alvaro Giron, Pittsburgh; John E. Jacoby; Ho Yu, both of Murrysville, all of Pa.

[73] Assignee: Aluminum Company of America, Pittsburgh, Pa.

[21] Appl. No.: 836,661

[22] Filed: Feb. 18, 1992

[51] Int. Cl.[5] ..... B22D 3/00; B22D 7/06; B22D 27/04

[52] U.S. Cl. ..... 164/128; 164/348; 249/174

[58] Field of Search ..... 249/174, 135; 164/DIG. 6, 126, 128, 348

[56] References Cited

U.S. PATENT DOCUMENTS

| | | | |
|---|---|---|---|
| 2,072,817 | 3/1937 | Hostetler | 164/412 X |
| 2,146,678 | 2/1939 | Jung . | |
| 2,157,097 | 5/1939 | Jung . | |
| 2,601,647 | 6/1952 | Upper | 249/174 |
| 3,007,586 | 11/1961 | Breesler . | |
| 3,017,042 | 1/1962 | Bertram et al. . | |
| 3,352,648 | 11/1967 | Harper et al. . | |
| 3,498,451 | 3/1970 | Foley et al. . | |
| 3,671,204 | 6/1972 | Foley et al. . | |
| 4,527,779 | 7/1985 | Roth et al. . | |
| 4,581,063 | 4/1986 | Oyabu et al. . | |
| 5,019,455 | 5/1991 | Downie et al. | 249/174 X |

FOREIGN PATENT DOCUMENTS

| | | | |
|---|---|---|---|
| 1194103 | 6/1965 | Fed. Rep. of Germany | 164/348 |
| 2579119 | 9/1986 | France . | |
| 52-53725 | 4/1977 | Japan | 164/DIG. 6 |
| 61-159245 | 7/1986 | Japan | 164/128 |
| 62-104665 | 5/1987 | Japan | 164/128 |
| 519273 | 7/1976 | U.S.S.R. | 249/174 |

*Primary Examiner*—J. Reed Batten, Jr.
*Attorney, Agent, or Firm*—Jones, Tullar & Cooper

[57] ABSTRACT

A mold for casting metal ingot sows having an aspect ratio of at least 4:1. The mold comprises a bottom wall from which a side wall extends upwardly and outwardly and from which heat transfer structure extends downwardly for transferring heat away from the bottom wall.

24 Claims, 15 Drawing Sheets

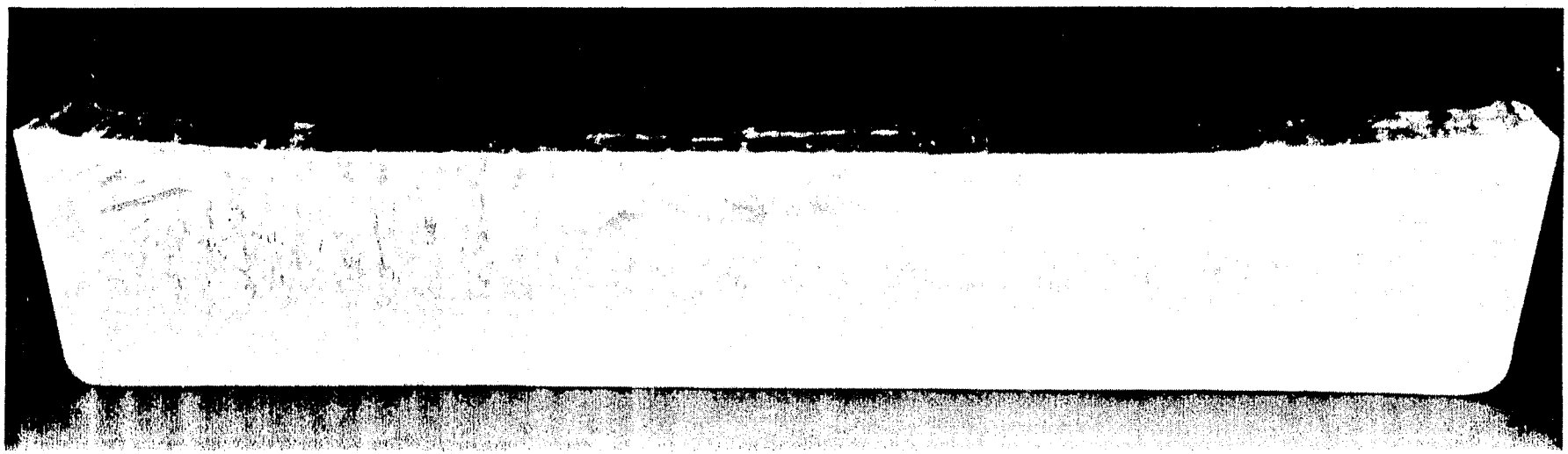
SOW #2
SLICE #8
FIG. 5 - GRAIN STRUCTURE IN SLICE 8 OF SOW 2 CAST IN NEW MOLD

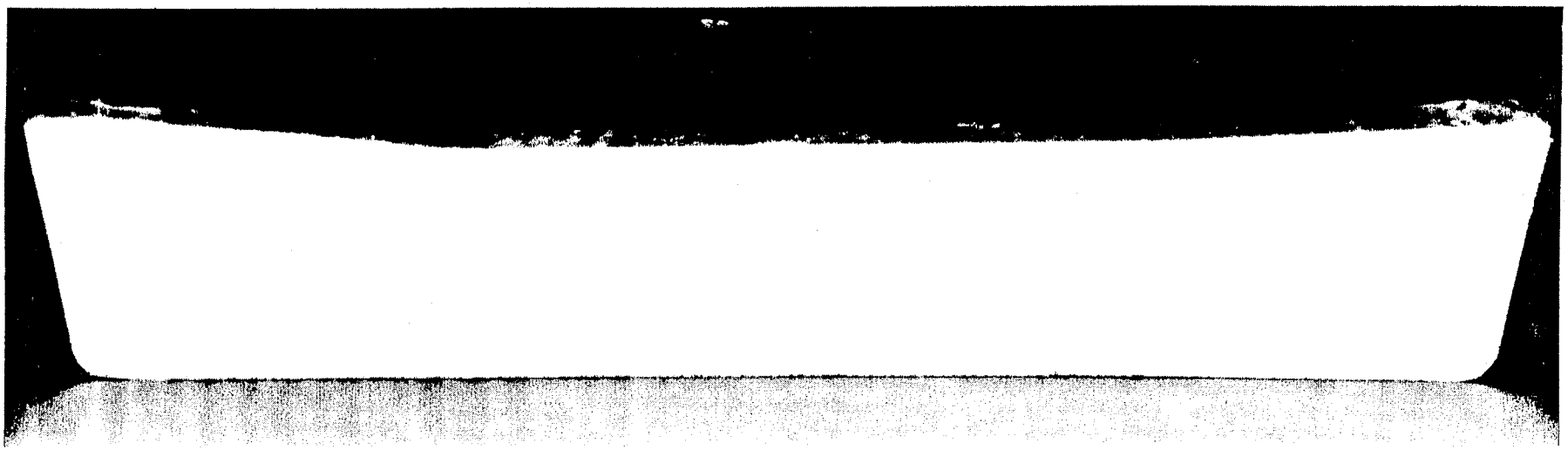
SOW #2
SLICE #3
FIG. 6 - GRAIN STRUCTURE IN SLICE 3 OF SOW 2 CAST IN NEW MOLD

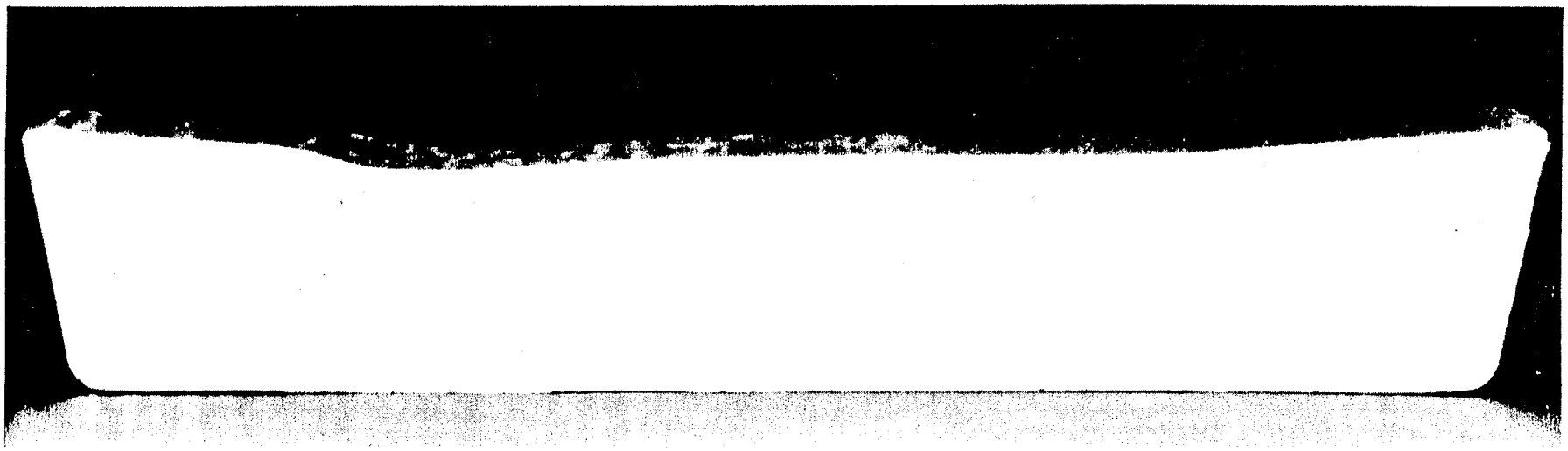
SOW #2
SLICE #7
FIG. 7 - GRAIN STRUCTURE IN SLICE 7 OF SOW 2 CAST IN NEW MOLD

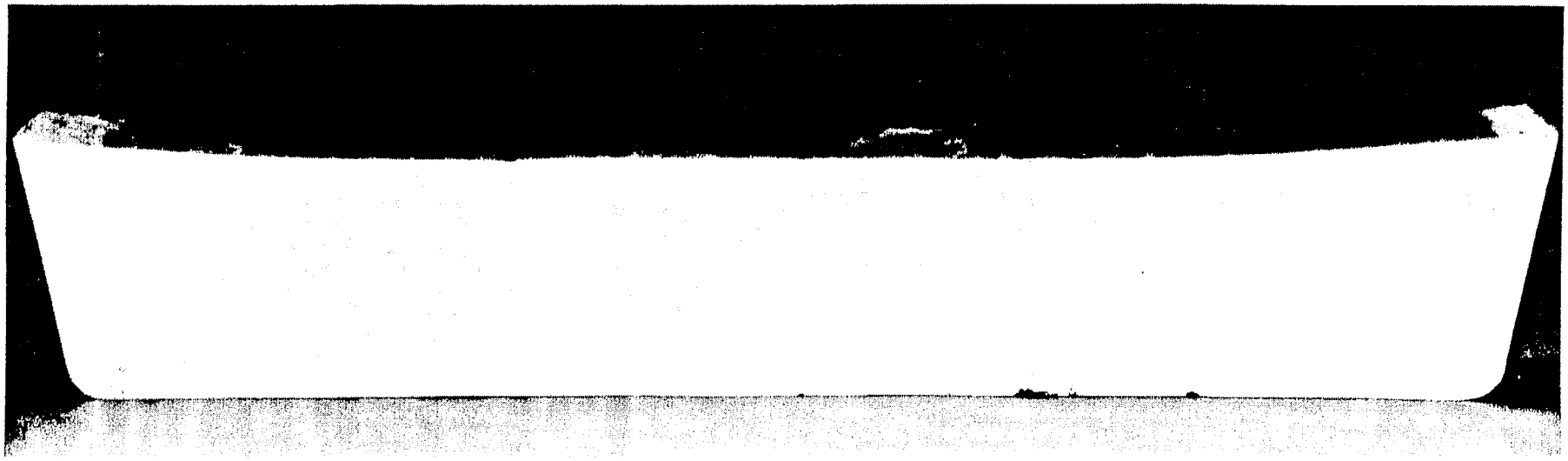
SOW # 3
SLICE # 8
FIG. 8 - GRAIN STRUCTURE IN SLICE 8 OF SOW 3 CAST IN NEW MOLD

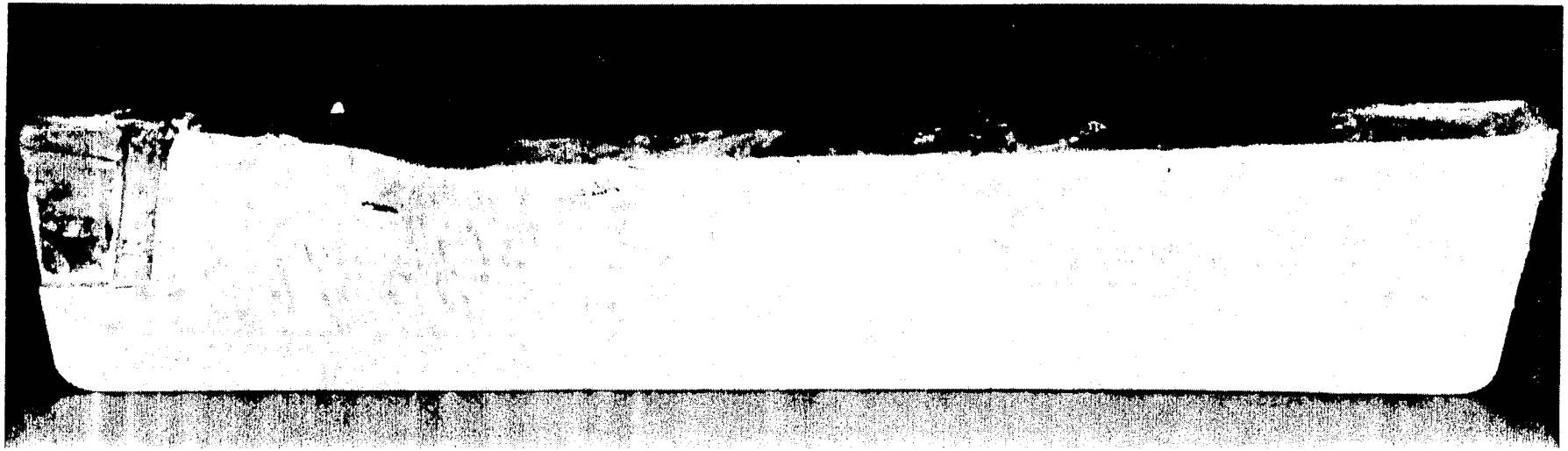
SOW #3
SLICE #3
FIG. 9 - GRAIN STRUCTURE IN SLICE 3 OF SOW 3 CAST IN NEW MOLD

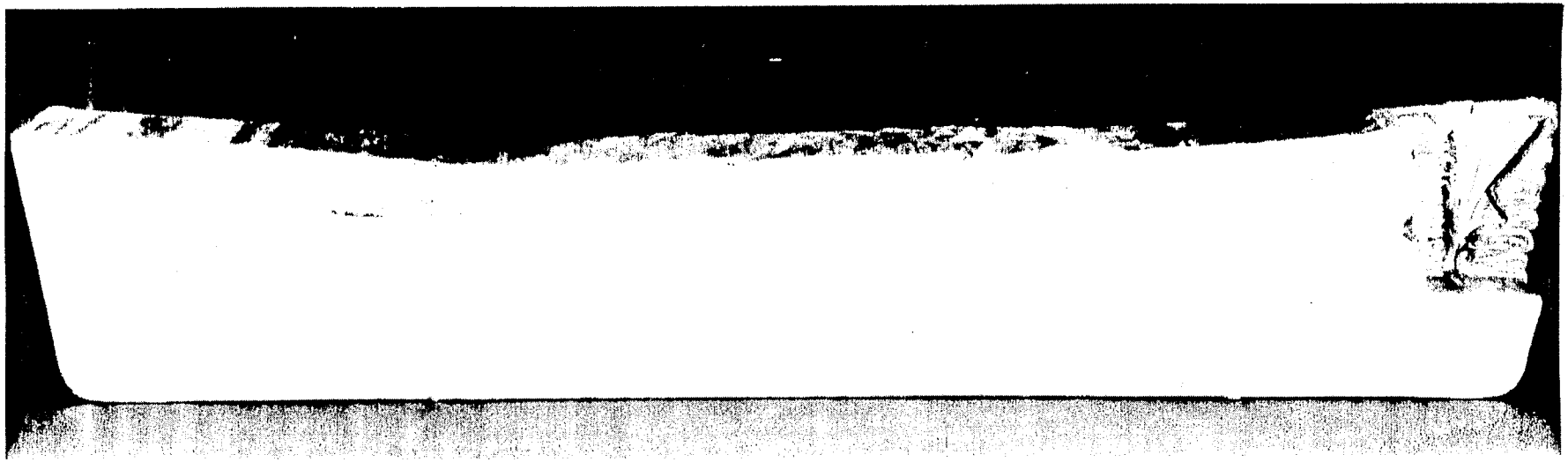
SOW #3
SLICE #7
FIG.10-GRAIN STRUCTURE IN SLICE 7 OF SOW 3 CAST IN NEW MOLD

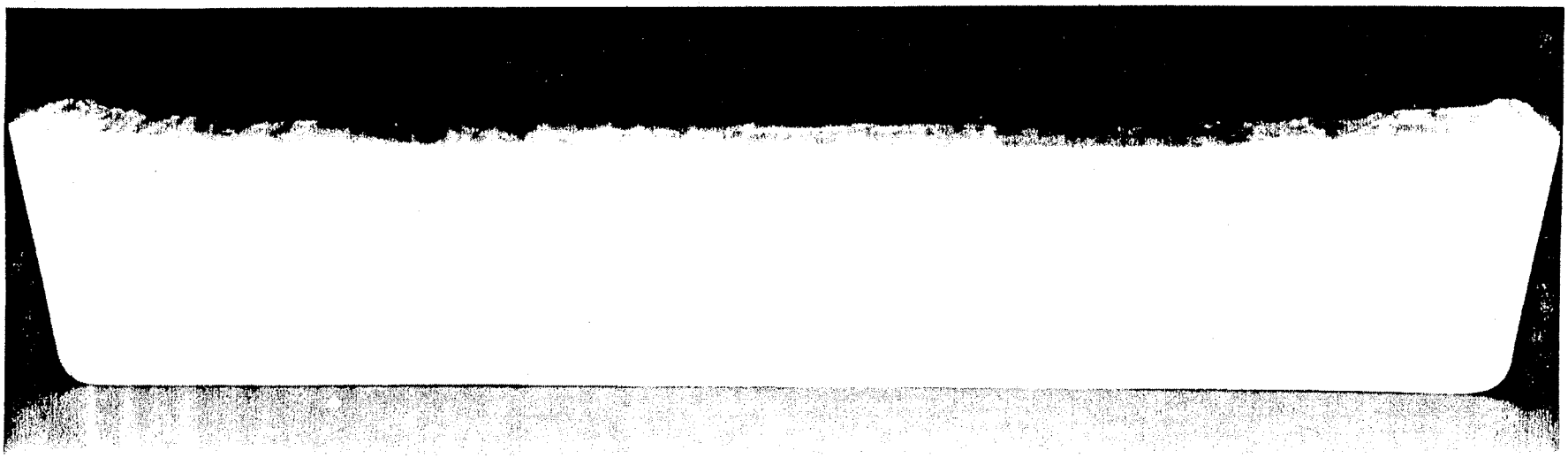
SOW # 2
SLICE # 8
FIG. 11 - DYE CHECK ANALYSIS OF SLICE 8 IN SOW 2 CAST IN NEW MOLD

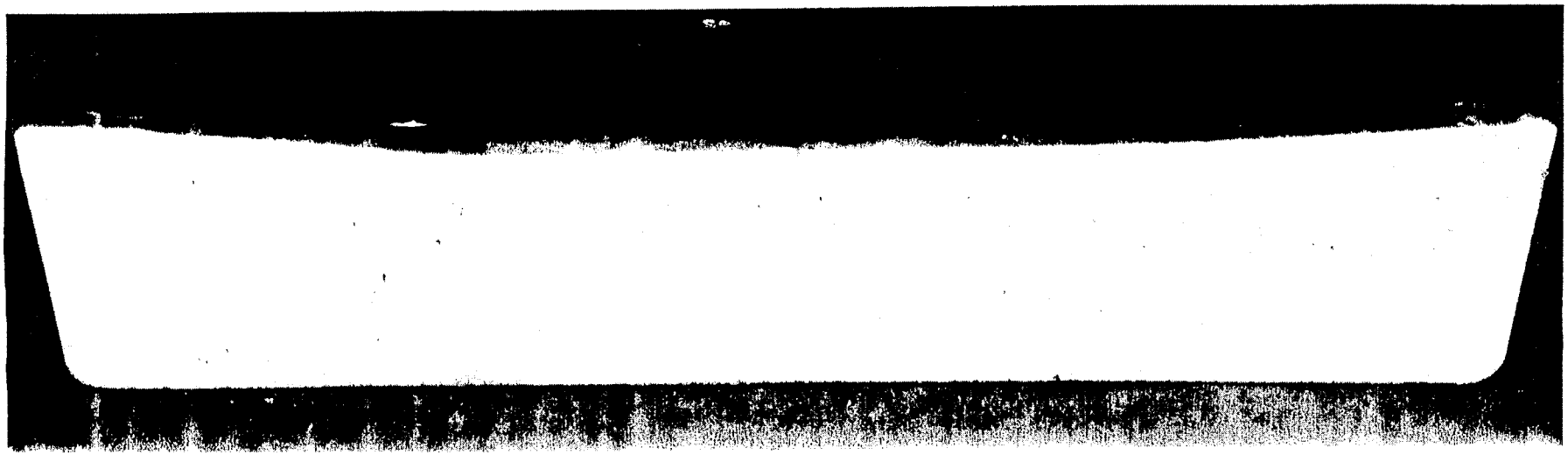
SOW #2
SLICE #3
FIG.12 - DYE CHECK ANALYSIS OF SLICE 3 IN SOW 2 CAST IN NEW MOLD

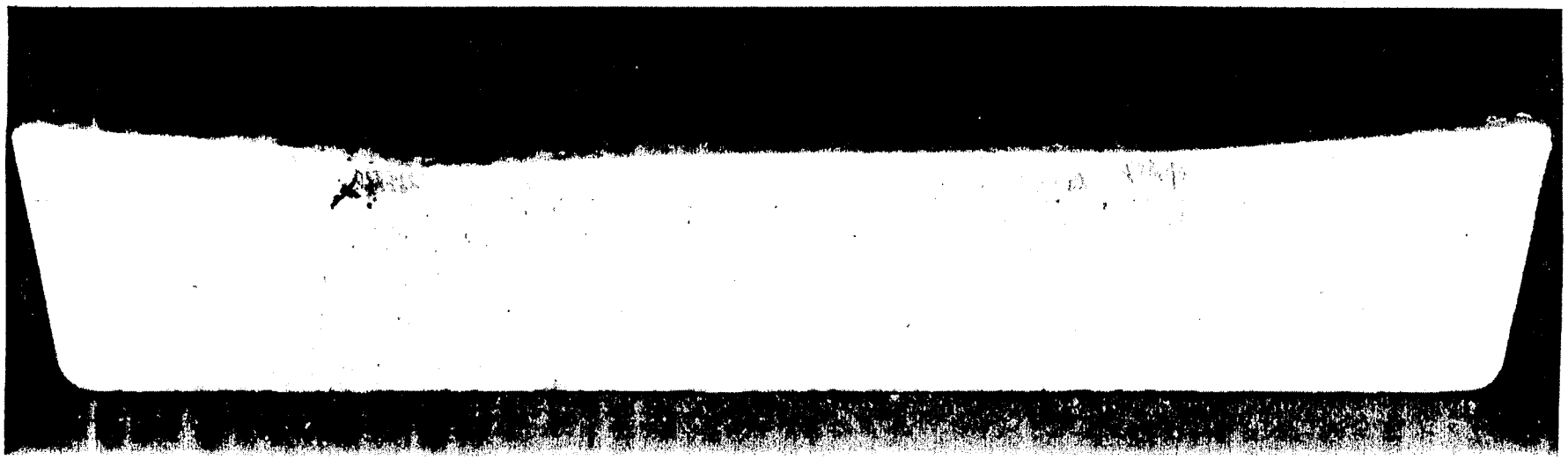
SOW #2
SLICE #7
FIG. 13 – DYE CHECK ANALYSIS OF SLICE 7 IN SOW 2 CAST IN NEW MOLD

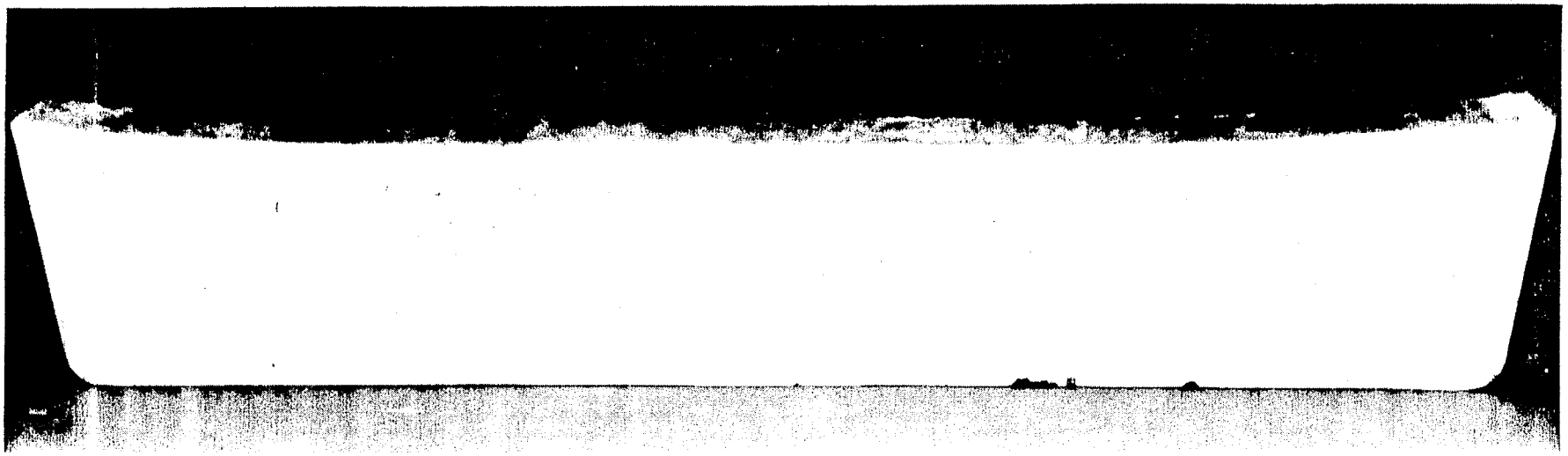
SOW #3
SLICE #8
FIG. 14 - DYE CHECK ANALYSIS OF SLICE 8 IN SOW 3 CAST IN NEW MOLD

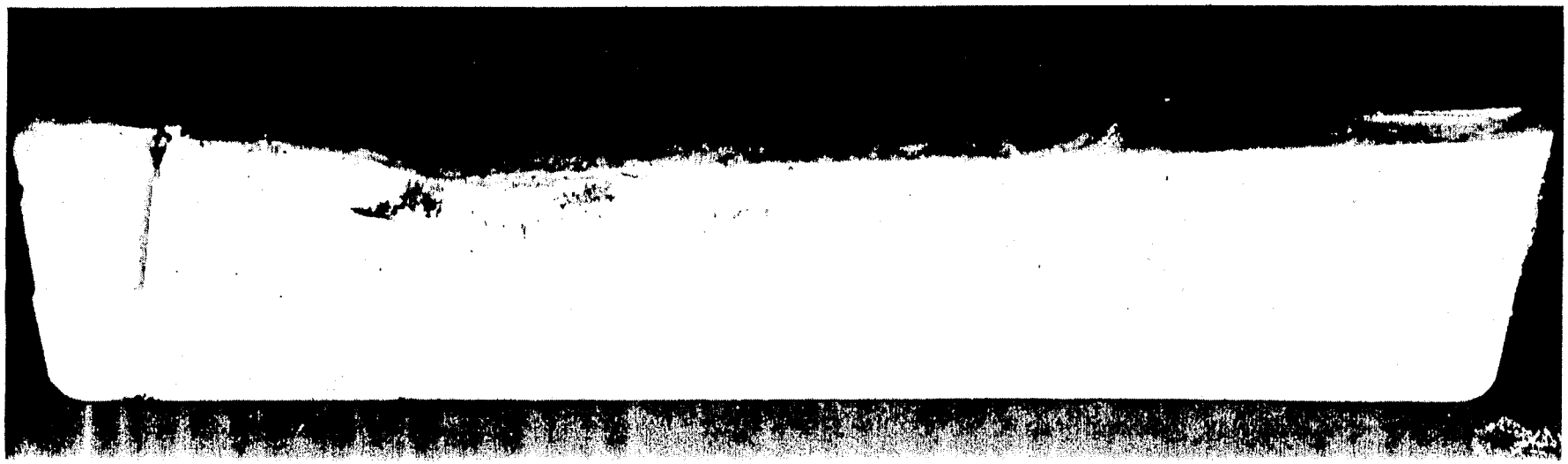
SOW # 3
SLICE # 3
FIG. 15 – DYE CHECK ANALYSIS OF SLICE 3 IN SOW 3 CAST IN NEW MOLD

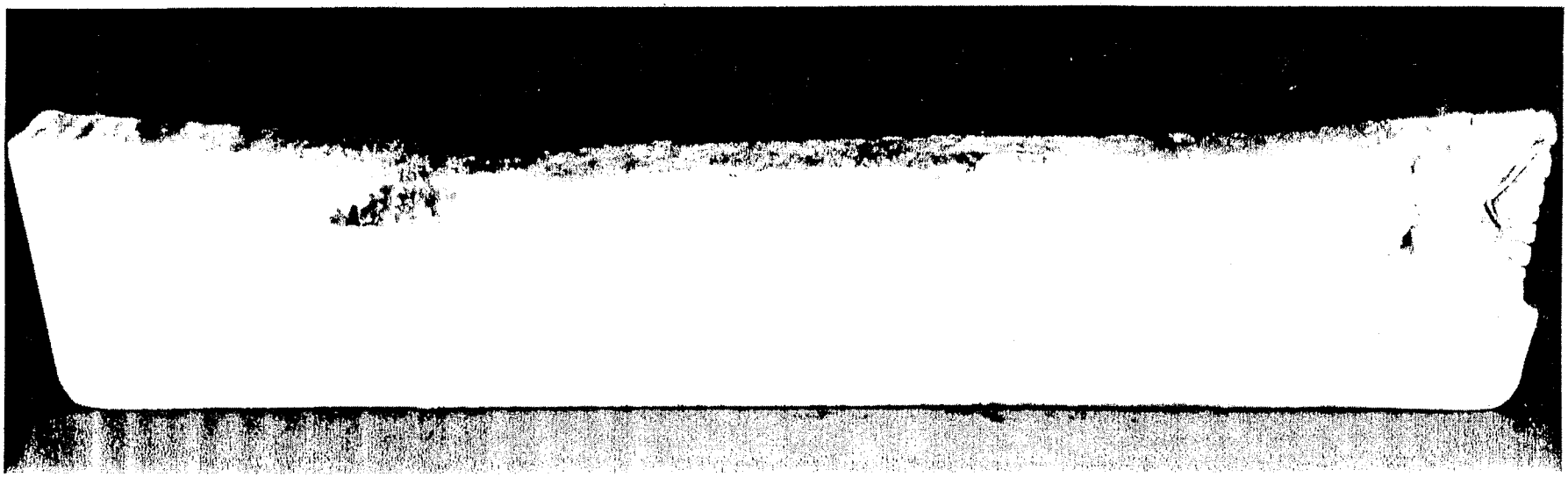
SOW # 3
SLICE # 7
FIG. 16 - DYE CHECK ANALYSIS OF SLICE 7 IN SOW 3 CAST IN NEW MOLD

MOLD FOR CASTING METAL INGOT SOWS AND METHOD

BACKGROUND OF THE INVENTION

This invention relates to a mold design for casting metal ingots, and in particular for casting aluminum ingot sows which are virtually cavity free, and to method of casting such sows.

A recurring problem in, for example, the remelting of aluminum sows is molten metal explosions. These explosions occur because of the internal cavities (shrinkage cavities) produced in the sows during their production, which production, for the most part, utilizes a warm mold, i.e., a mold that is used to cast several sows without allowing it to cool between casts.

These cavities are produced by the uneven heat dissipation from the mold during the production of the ingot producing voids in the body of the ingot within which moisture may accumulate. Sows containing these cavities represent a serious hazard for personnel and equipment in a cast shop. This is because the moisture accumulated in the cavities can create an explosion hazard when the sow is charged into molten metal in a furnace, for example, a remelt furnace.

If the remelt sow does not contain internal cavities, indoor storage in a heated building is sufficient to remove any surface moisture that accumulates. However, if the remelt sow contains internal cavities and has been exposed to outdoor storage, nothing short of furnace drying will eliminate the potential for serious explosions should the remelt sow be immersed in molten aluminum.

Although furnace drying is an expensive proposition, the risk associated with charging a remelt sow into molten aluminum when water is entrapped in the interior is unacceptable.

It would, therefore, be desirable to have some means of improving the state of cast metal ingots so that the noted internal cavities are minimized if not eliminated, and to achieve this state during the formation of the ingots.

SUMMARY OF THE INVENTION

The achievement of this objective has been approached from a consideration of the heat transfer which occurs in and from the ingot and mold. It has been determined that to cast cavity free sows heat losses from the top and sides of the sow must be minimized, and heat transferred from the bottom must be maximized. Heat transferred from the top can be minimized by covering the top of the mold with insulation, but because of practical difficulties in a plant environment this would be difficult to do. The same applies to the use of mold side insulation. It was decided that to address the problem would require mold redesign, and specifically to design a mold with a large aspect ratio, i.e., length to depth ratio, and on occasion with massive bottoms. It has been found that casting sows with large aspect ratios ensures that heat is lost at a lower rate from the sow sides than from the top and bottom. The role of the mold bottom is to act as a heat sink and to ensure that heat is extracted fast enough from the bottom so that when solidification reaches the top surface the center part of the top is still a molten surface At this point the possibility of forming a cavity depends on the amount of molten metal remaining and the thickness of the upper shell. If the shell is thin, it may collapse producing the desired effect of closing the cavity. If it is thick, a shrinkage cavity is likely to form. Also, when casting sows in a hot mold, the mold bottom can no longer act as a good heat sink and the rates of heat extraction from the mold bottom and the sow top are comparable. As a result, a thick upper shell forms and a shrinkage cavity is likely to occur.

The invention addresses the problem of the internal cavities and proposes a unique solution in the form of a mold having a desirable aspect ratio and effective heat transfer means associated with the bottom wall of the mold.

Preferably, the mold has in addition to a bottom wall a side wall(s) which extend upwardly and outwardly (tapered) from the bottom wall, at least three leg portions extending downwardly from the bottom wall as well as heat transfer structures which can be embodied as at least one heat transfer fin which also extends downwardly from the bottom surface.

The thickness of the heat transfer structure is less than the thickness of at least the bottom wall.

The bottom wall and side wall(s) define a cavity for receiving metal to be cast. The height (upper extent) and planar extent of the cavity defined by the bottom wall and side wall(s) of the mold are such that the ratio of any planar extent to the height (upper extent) is at least 4:1, i.e., the aspect ratio of the mold is at least 4:1, and preferably 5:1 or more.

The large aspect ratio (4:1 or more) along with the heat transfer structure attached to the bottom wall of the mold enhances heat transfer rates from the mold resulting in a more controlled cooling of the sow. The sow solidifies faster with its upper shell being thinner and more likely to collapse thereby closing any shrinkage cavity that may form.

BRIEF DESCRIPTION OF THE DRAWINGS

Three figures have been selected to illustrate a preferred embodiment of the mold of the present invention. In addition, thirteen figures are presented which illustrate the results of several experiments that were conducted to test the mold design illustrated in the noted first three figures. Included are:

FIGS. 5-16 which are photographs of the various slices of two sows that were tested.

DESCRIPTION OF THE PREFERRED EMBODIMENTS

Figure 1:
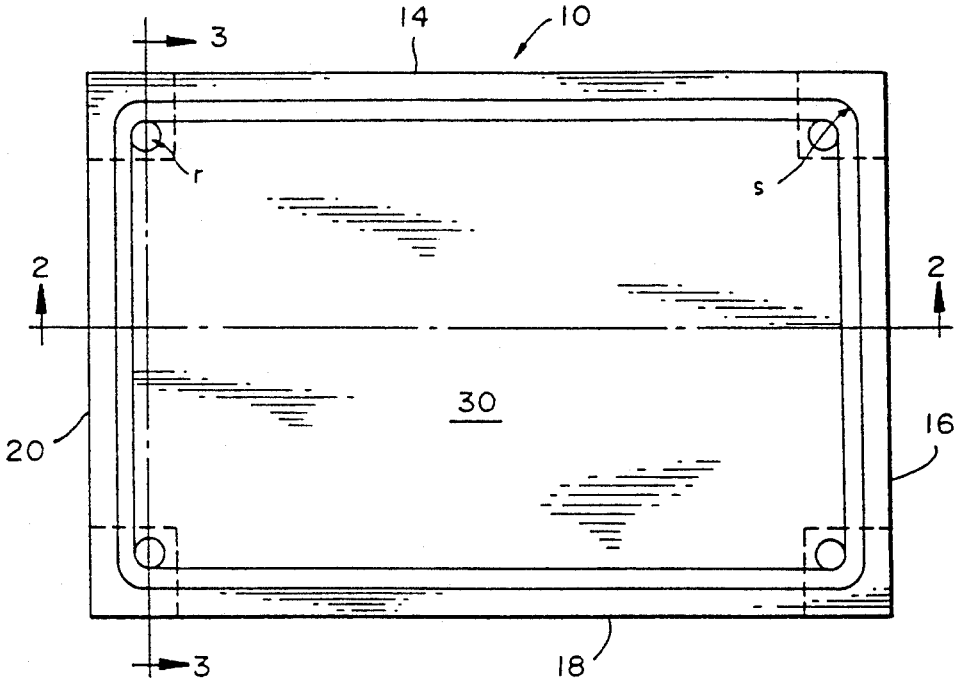
FIG. 1 which is a top plane view of the mold according to a preferred embodiment of the invention.
Figure 2:
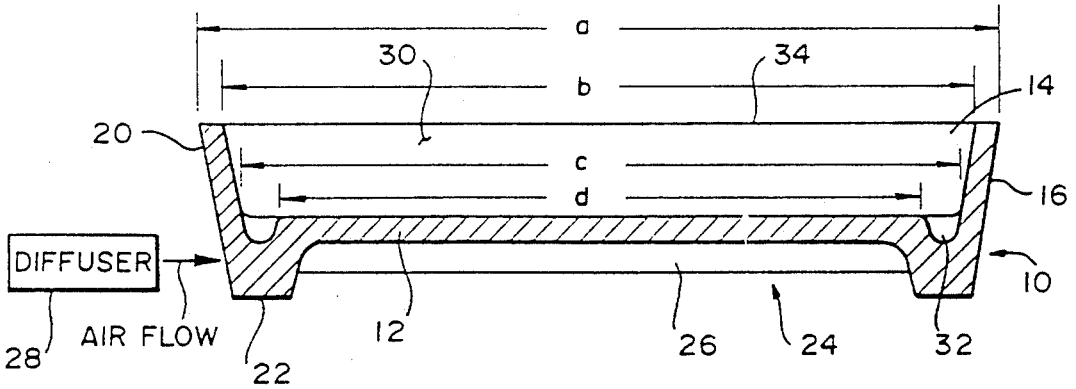
FIG. 2 which is a cross-sectional view taken along lines 2—2 of FIG. 1.
Figure 3:
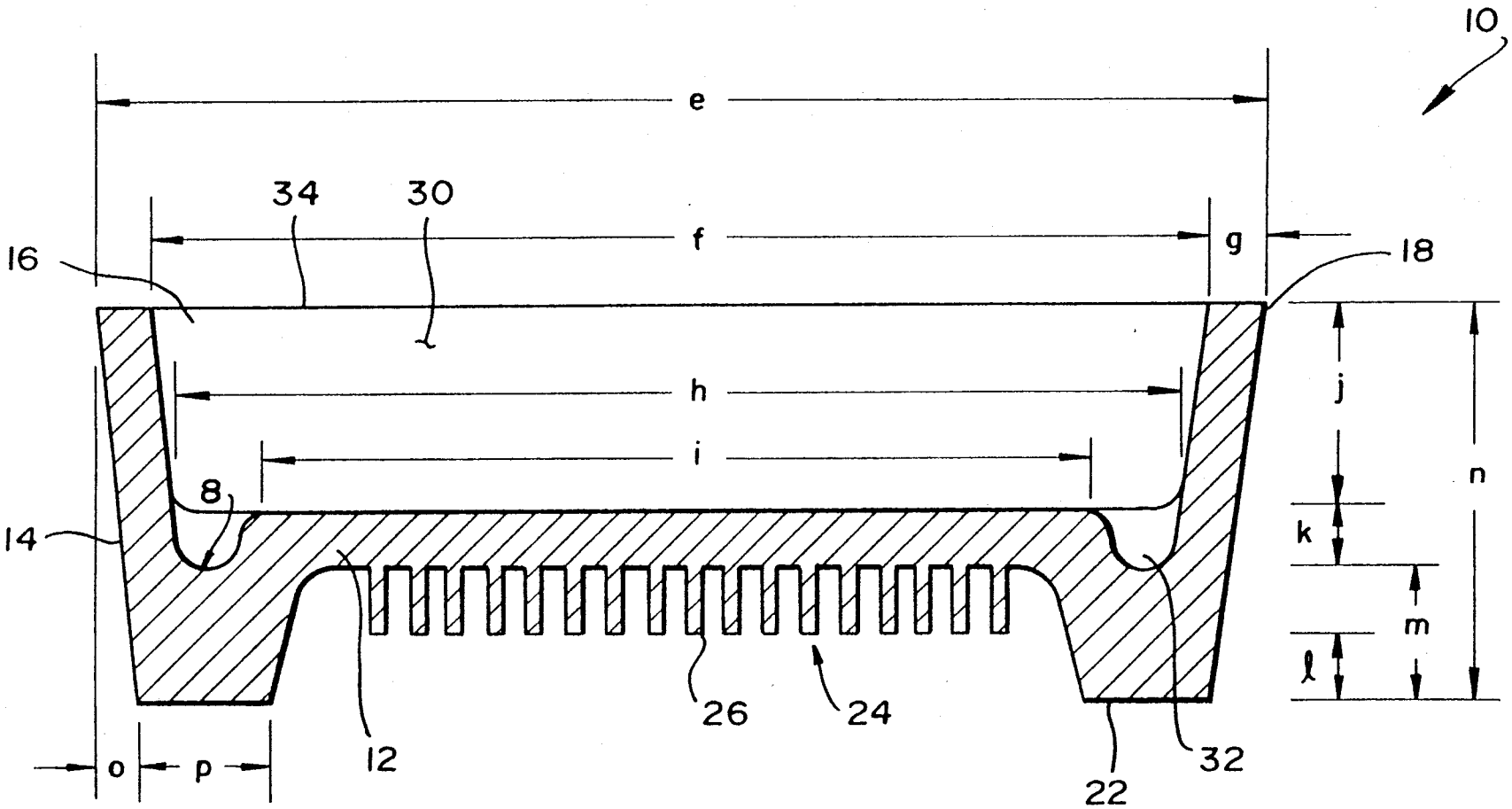
FIG. 3 which is a cross-sectional view taken along lines 3—3 of FIG. 1.

A mold 10 according to a preferred embodiment of the present invention is illustrated in FIGS. 1-3. The mold 10 is preferably rectangular in shape, although other shapes are contemplated. The mold 10 is made of metal, preferably a ductile iron.

The components of the mold include: a bottom wall 12; a side wall, which in the illustrated embodiment comprises four complementary walls 14, 18 and 16, 20 which extend upwardly and outwardly from the bottom wall; leg portions, which in the illustrated embodiment comprises four leg portions 22, each located at a corner of the mold; and a heat transfer structure extending downwardly from the bottom wall, which in the illustrated embodiment comprises a plurality of fins 26.

The mold is formed as a unitary structure with the side walls and bottom wall arranged to have the same thickness, although they can be different. The fins 26 are arranged to be parallel to each other and of equal thickness throughout their longitudinal extent, although here too, the spacing relationship (parallelism) and thickness can vary. So too can their location, i.e., the fins 26 can be directed in the transverse direction of the mold rather than the longitudinal. In any case, the leg portions extend downwardly further than the fins so that a clearance is created between the outer extremity of the fins and the supporting surface for the mold. This allows for better heat transfer from the fins. In addition, a cooling fluid, such as air, can be circulated, in a known manner, past the fins and bottom surface to further enhance heat transfer. For example, a diffuser 28, shown schematically in FIG. 2, can be utilized in assembly with the mold 10.

The bottom wall 12 and the side walls 14–20, together define a cavity 30 into which molten metal (aluminum, for example) is poured for casting into an ingot. Note that the floor of the cavity 30 is defined by the top surface of the bottom wall to be essentially flat, straight with recesses 32 located at each leg portion, and in this case at each corner of the bottom wall. These recesses serve to form leg portions of the cast ingot. In addition to the essentially flat top surface of the bottom wall, the side walls define essentially flat, straight side walls of the cavity which taper outwardly as shown in FIGS. 2 and 3. The taper is provided in order to facilitate removal of the cast ingot from the mold.

The essentially flat surfaces of the cavity are desirable as they offer a high percentage of contact with the side and bottom surfaces of the ingot for better heat dissipation during cooling. The high percentage contact works especially advantageously where the walls of the mold are of essentially equal thickness.

It is preferable to have the greatest heat dissipation proceed through the floor of the mold, i.e., the bottom wall, and for this purpose the heat transfer structure in the form of parallel arranged fins 26 is provided which extend from the bottom wall 12. The rectangular plate-like fins 26 shown in FIGS. 2 and 3 are preferably thinner than the thickness of the bottom wall. Each fin is surrounded by air or some other heat dissipating fluid, which may be forced into contact with the fins and bottom wall as well as moved past the fins and bottom wall. This arrangement draws heat from the mold and dissipates it relatively rapidly.

EXAMPLE

It was found from a developed mathematical model that cavity formation depends on the amount of molten metal remaining when the top surface of the sow solidifies as well as on the final thickness of the top surface shell. These two factors determine whether the shell will or will not collapse to close the cavity.

The geometry of a mold configured according to the present invention for the purpose of producing and testing cast ingots is given in the table below:

| dimension | in. |
|---|---|
| a | 64 |
| b | 60 |
| c | 58 |
| d | 52 |
| e | 44 |
| f | 40 |
| g | 2 |
| h | 38 |
| i | 32 |
| j | 8 |
| k | 2 |
| l | 2 |
| m | 5 |
| n | 15 |
| o | 2 |
| p | 5 |
| q | 1 |
| r | 1 |
| s | 2 |

The dimensions noted in the table were chosen so that the resulting sow cast in the mold (uninsulated) would weigh approximately 1800 lbs. Under these conditions the mold is filled to a height of 1.0 in. below the mold rim 34.

Experiments were conducted using a melt temperature of 1400° F. (760° C.). The metal was poured to a level 1 in. below the mold rim, as noted above. Thus, the resulting sows were 7 ins. thick. To enhance cooling of the mold, compressed air was blown uniformly through the passages of the fins along the mold bottom by using a diffuser or similar device. Air velocities of 4000 fpm were measured at the exit of the mold passages.

Figure 4:
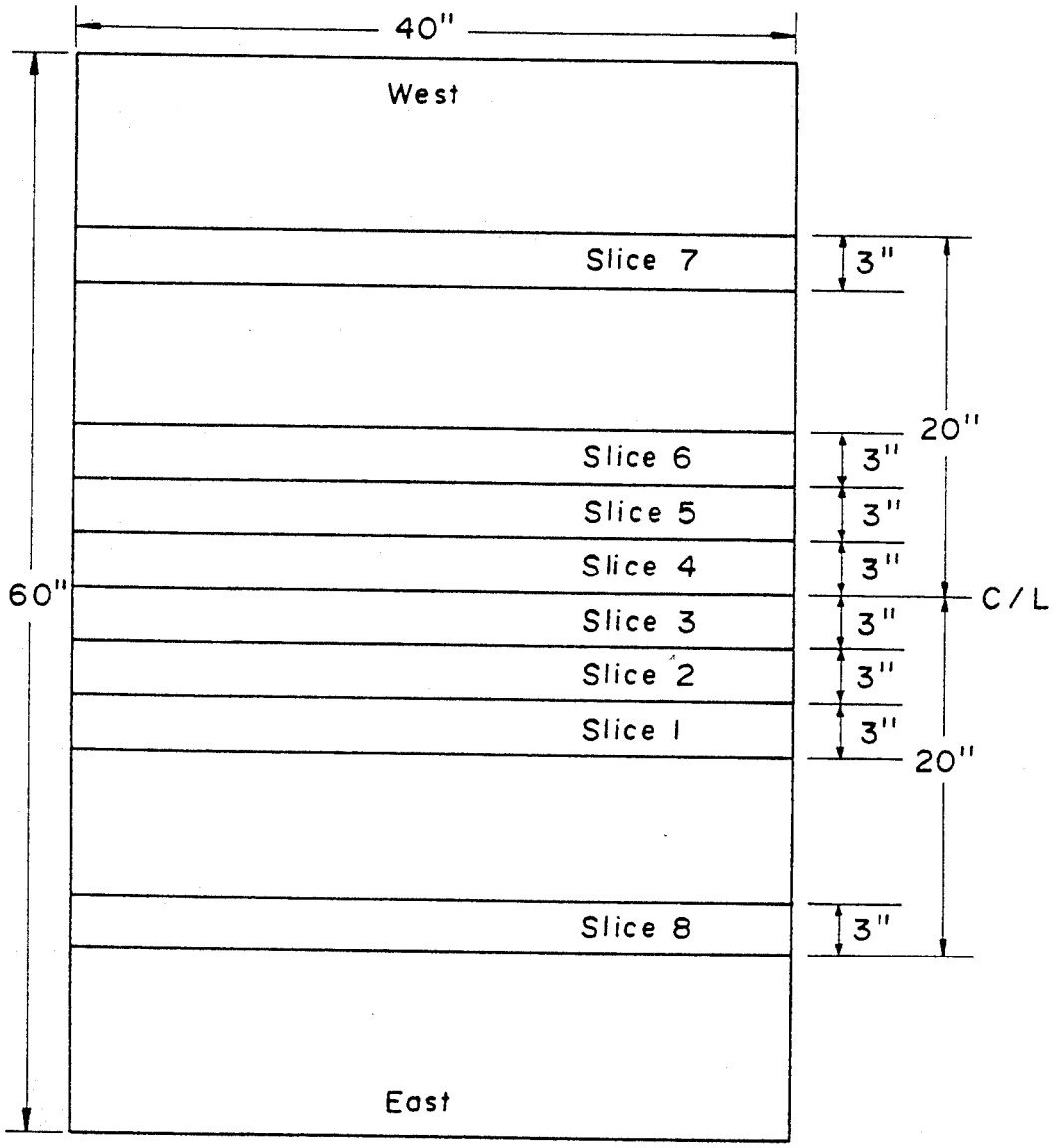
FIG. 4 which schematically illustrates the top of a cast sow with the location of slices for shrinkage cavity analysis to demonstrate the viability of the mold of FIGS. 1-3.

To check for shrinkage cavities, the sows were sectioned, as shown in FIG. 4, and visually inspected. Slices taken from the sows were subsequently etched and dye-checked to allow for analysis of the grain structure and to check for porosity. FIG. 4 also shows the labels East and West to show the direction of air flow (east to west) during casting.

FIGS. 5 through 7 show slices 8, 3 and 7 from sow 2. As observed, sow 2 was basically sound, except for a small shrinkage cavity in slice 7. The grain structure in these slices indicates that cooling occurred primarily from the bottom of the sow, although some solidification occurred from the top of the sow. the top surface shell was thinner in slice 8 than in slices 3 and 7. This indicates that slices 3 and 7 took longer to solidify than slice 8. This was to be expected since the temperature of the cooling air at the mold bottom increased substantially between inlet and exit. As a result, mold cooling became less efficient as the cooling air moved from east to west in FIG. 4. To eliminate this problem it is proposed to control the heat gradient of the air to be more uniform by, for example, increasing the flow rate, utilizing more than one diffuser along the extent of the fins, or by directing the fins transversely (short axis) rather than longitudinally (long axis) of the mold.

FIGS. 8 through 10 show the same situation for sow 3. In this case, however, small shrinkage cavities were observed in slices 3 and 7. As with sow 2, the thickness of the solidified top surface shell increased from east to west. Thus, slices 3 and 7 took longer to solidify than slice 8. Again, heating of the cooling air is though to be the cause of this phenomenon.

Slice 7 in sows 2 and 3 showed a shrinkage cavity at about the same location. However, slice 3 in sow 3 contained a shrinkage cavity not present in sow 2. FIG. 9 shows that this cavity may have formed as a result of the strong side cooling effect of a steel wedge placed in the mold to allow removal of the sow after casting. The grain structure in this figure shows that at the location of this cavity, side cooling was as strong as bottom cooling. The thick side shell prevented the top surface shell from collapsing causing the formation of this cavity.

FIGS. 11 through 16 show the slices discussed above after dye-checking. This was a test done to evaluate shrinkage porosity in the sows. As seen in FIGS. 12 through 14, the level of porosity increased from east to west in the sow. Porosity was minimal in slice 8, but increased in slices 3 and 7. Increases in the porosity levels are another indication that slices 3 and 7 solidified more slowly than slice 8. Of special significance is the fact that the level of porosity is highest at the top surface of all the slices examined. This would indicate the need to dry the sows prior to charging into molten metal.

FIGS. 14 through 16 show the results of the same test for slices 8, 3 and 7 in sow 3. The same comments as for sow 2 would apply here as well.

These tests demonstrate the viability of the mold with a transverse aspect ratio of f/(j - 1 in):1, i.e., 40/7:1, or 5.71:1, and a longitudinal aspect ratio of b/(j - 1 in):1, i.e., 60/7:1, or 8.57:1; and a plurality of heat transfer fins whose height was 3 in, to produce a sow which can be expected to be virtually cavity free.

What is claimed is:

1. A mold for casting metal ingot sows, comprising:

a bottom wall;

a side wall extending upwardly and outwardly from the bottom wall, and defining with the bottom wall a cavity for receiving molten metal, said cavity having an upper extent defined by said side wall and a planar extent defined by said side wall and said bottom wall, the ratio of said planar extent to said upper extent being at least 4:1; and heat transfer means extending downwardly from said bottom wall.

2. The mold as defined in claim 1, further comprising:

at least three leg portions extending downwardly from said bottom wall, wherein the downward extent of said heat transfer means is less than the downward extent of said leg portions.

3. The mold as defined in claim 2, wherein said heat transfer means comprises a plurality of mutually parallel heat transfer fins.

4. The mold as defined in claim 3, each fin having a thickness less than the thickness of said bottom wall.

5. A mold for casting metal ingot sows, comprising:

a bottom wall;

complementary side walls extending upwardly and outwardly from the bottom wall, and defining with the bottom wall a cavity for receiving molten metal to be cast, said cavity having a longitudinal extent and a transverse extent, with the ratio of at least one of said longitudinal extent and said transverse extent to the upward extent of said side walls is at least 4:1; and heat transfer means extending downwardly from said bottom wall.

6. The mold as defined in claim 5, further comprising:

at least three leg portions extending downwardly from said bottom wall, wherein the downward extent of said heat transfer means is less than the downward extent of said leg portions.

7. The mold as defined in claim 6, wherein four leg portions are provided, each extending downwardly from said bottom wall.

8. The mold as defined in claim 6, wherein said heat transfer means comprises a plurality of mutually parallel heat transfer fins.

9. The mold as defined in claim 8, each fin having a thickness less than the thickness of said bottom wall.

10. The mold as defined in claim 9, wherein four leg portions are provided, each extending downwardly from said bottom wall, and wherein said plurality of heat transfer fins extend along said bottom wall between adjacent ones of said leg portions.

11. The mold as defined in claim 7, further comprising:

a recess defined at least corner of said bottom wall in said cavity, each recess extending into a respective one of said leg portions.

12. A mold for casting aluminum ingot sows, comprising:

a rectangular bottom wall;

a side wall extending upwardly and outwardly from each side of said bottom wall, and defining with the bottom wall a rectangular cavity for receiving molten aluminum to be cast, said cavity having a longitudinal extent and a transverse extent, with the ratio of at least one of said longitudinal extent and said transverse extent to the upward extent of said side wall is at least 4:1; and heat transfer means extending downwardly from said bottom wall.

13. The mold as defined in claim 12, further comprising:

at least three leg portions extending downwardly from said bottom wall, wherein the downward extent of said heat transfer means is less than the downward extent of said leg portions.

14. The mold as defined in claim 13, wherein four leg portions are provided, each extending downwardly from said bottom wall.

15. The mold as defined in claim 13, wherein said heat transfer means comprises a plurality of mutually parallel heat transfer fins.

16. The mold as defined in claim 15, each fin having a thickness less than the thickness of said bottom wall.

17. The mold as defined in claim 16, wherein four leg portions are provided, each extending downwardly from said bottom wall, and wherein said plurality of heat transfer fins extend along said bottom wall between adjacent ones of said leg portions.

18. The mold as defined in claim 14, further comprising:

a recess defined at each corner of said bottom wall in said cavity, each recess extending into a respective one of said leg portions.

19. A mold assembly for casting metal ingot sows, comprising:

a mold having:

a bottom wall;

a side wall extending upwardly and outwardly from the bottom wall, and defining with the bottom wall a cavity for receiving molten metal, said cavity having an upper extent defined by said side wall and a planar extent defined by said side wall and said bottom wall, the ratio of said planar extent to said upper extent being at least 4:1; and heat transfer means extending downwardly from said bottom wall; and means for passing a heat transfer fluid past said heat transfer means for receiving heat from said heat transfer means.

20. A mold assembly for casting metal ingot sows, comprising:

a mold having:

a bottom wall;

complementary side walls extending upwardly and outwardly from a bottom wall, and defining with the bottom wall a cavity for receiving molten metal to be cast, said cavity having a longitudinal extent and a transverse extent, with the ratio of at least one of said longitudinal extent and said transverse extent to the upward extent of said side walls is at least 4:1; and heat transfer means extending downwardly form said bottom wall; and means for passing a heat transfer fluid past said heat transfer means for receiving heat from said heat transfer means.

21. A mold assembly for casting metal ingot sows, comprising:

a mold having:

a rectangular bottom wall;

a side wall extending upwardly and outwardly from each side of said wall, and defining with the bottom wall a rectangular cavity for receiving molten metal to be cast, said cavity having a longitudinal extent and a transverse extent, with the ratio of at least one of said longitudinal extent and said transverse extent to the upward extent of said side wall is at least 4:1; and heat transfer means extending downwardly from said bottom wall; and means for passing a heat transfer fluid past said heat transfer means for receiving heat from said heat transfer means.

22. A method of casting metal ingot sows in a mold: having a bottom wall; and a side wall extending upwardly and outwardly from the bottom wall and defining with the bottom wall a cavity for receiving molten metal, the cavity having an upper extent defined by the side wall and a planar extent defined by the side wall and the bottom wall, the ratio of said planar extent to said upper extent is at least 4:1, and with heat transfer means extending downwardly from said bottom wall, comprising the steps of:

pouring a molten metal into the cavity having said ratio and said heat transfer means, transferring heat from the molten metal through said bottom wall to a greater extent than from said side wall and the top of the molten metal in the cavity, thereby producing a metal ingot sow substantially free of internal cavities; and circulating a heat transfer fluid past said heat transfer means for receiving heat from said heat transfer means.

23. The method as defined in claim 22, wherein a diffuser is utilized in the step of circulating.

24. The method as defined in claim 22, wherein the molten metal is aluminum.

* * * * *